US008763413B2

(12) United States Patent
Furutachi

(10) Patent No.: US 8,763,413 B2
(45) Date of Patent: Jul. 1, 2014

(54) STORAGE TYPE AIR CONDITIONING SYSTEM, AND OPERATION METHOD AND CONTROL PROGRAM FOR STORAGE TYPE AIR CONDITIONING SYSTEM

(75) Inventor: Hideaki Furutachi, Ora-gun (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 101 days.

(21) Appl. No.: 11/943,805

(22) Filed: Nov. 21, 2007

(65) Prior Publication Data

US 2008/0184716 A1 Aug. 7, 2008

(30) Foreign Application Priority Data

Nov. 24, 2006 (JP) ..... 2006-316452

(51) Int. Cl.
*F25B 27/00* (2006.01)

(52) U.S. Cl.
USPC ..... 62/236; 62/55

(58) Field of Classification Search
USPC ..... 62/236, 59; 307/66
See application file for complete search history.

(56) References Cited

U.S. PATENT DOCUMENTS

| | | | | |
|---|---|---|---|---|
| 6,990,593 | B2 * | 1/2006 | Nakagawa | 713/300 |
| 2003/0061828 | A1 * | 4/2003 | Blevins | 62/236 |
| 2003/0230099 | A1 * | 12/2003 | Moon et al. | 62/175 |
| 2004/0000892 | A1 * | 1/2004 | Jae-Seung | 320/132 |
| 2005/0275290 | A1 * | 12/2005 | Inn et al. | 307/55 |
| 2006/0260335 | A1 * | 11/2006 | Montuoro et al. | 62/236 |

FOREIGN PATENT DOCUMENTS

| | | | |
|---|---|---|---|
| JP | 06-074537 | A | 3/1994 |
| JP | 11-072262 | A | 3/1999 |
| JP | 2001-339855 | A | 12/2001 |
| JP | 2002-309927 | A | 10/2002 |
| JP | 2003-185235 | A | 7/2003 |
| JP | 2006-174540 | A | 6/2006 |

OTHER PUBLICATIONS

Extended European Search Report dated Feb. 4, 2013, issued in corresponding European Patent Application No. 07022777.2.
Japanese Office Action dated Sep. 13, 2011, issued in corresponding Japanese Patent Application No. 2006-316452.

* cited by examiner

*Primary Examiner* — Cassey D Bauer
(74) *Attorney, Agent, or Firm* — Westerman, Hattori, Daniels & Adrian, LLP

(57) ABSTRACT

In a storage type air conditioning system having plural storage type air conditioners, each air conditioner includes a storage battery in which external power from an external power source can be stored, an air conditioning unit that is supplied with stored power from the storage battery and perform an air conditioning operation, a residual amount detector for detecting a storage residual amount of the storage battery, and a stored power transmission/reception switching unit for switching transmission/reception of the stored power stored in the storage battery to/from the other storage type air conditioners. Information concerning the storage residual amounts of the storage batteries of the air conditioners are communicated with one another, and the stored power of the storage battery of some air conditioner having surplus stored power is supplied to another air conditioner having short stored power.

10 Claims, 7 Drawing Sheets

STORAGE TYPE AIR CONDITIONING SYSTEM, AND OPERATION METHOD AND CONTROL PROGRAM FOR STORAGE TYPE AIR CONDITIONING SYSTEM

CLAIM OF PRIORITY

The present application claims priority under 35 U.S.C. §119 to Japanese Patent Application No. 2006-316452 filed on Nov. 24, 2006.

BACKGROUND OF THE INVENTION

1. Field of the Invention

The present invention relates to a storage type air conditioning system including a plurality of air conditioners each having a storage battery which can store external power, and an operation method and a control program for the storage type air conditioning system.

2. Description of the Related Art

Reduction of emission of carbon dioxide ($CO_2$) as one greenhouse gas has been recently required to prevent global warming. In order to reduce the emission of $CO_2$, it is important to make power supply more efficient on the basis of equalization of power demand. Power demand for air conditioning is known as one of factors inducing disparity in power demand of a day, and it is estimated that the factor of pushing up the peak value of the power demand resides in that air conditioners are actuated all together in the daytime during the summer season or the like. In order to solve such a problem, a storage type air conditioner has been hitherto known (for example, see JP-A-2002-309927).

Generally, a storage type air conditioner has a storage battery, and it charges the storage battery in the nighttime in which power demand is little and discharges the storage battery in the daytime to execute air conditioning operation by using stored power. If such a storage type air conditioner is utilized, it contributes to equalization of power demand and thus reduces the power generation amount of an electric power company, whereby the emission of $CO_2$ can be reduced.

However, when the conventional storage type air conditioner has stored power more than the power amount (electric energy) required for its own air conditioning operation, it has been impossible to effectively use this extra stored power and thus further equalize the power demand.

SUMMARY OF THE INVENTION

Therefore, the present invention has been implemented in view of the foregoing problem, and has an object to provide a storage type air conditioning system that can proactively use stored power, and an operation method and a control program for the storage type air conditioning system.

In order to attain the above object, according to a first aspect of the present invention, there is provided a storage type air conditioning system having plural storage type air conditioners each of which comprises: a storage battery in which external power from an external power source can be stored; an air conditioning unit that is supplied with stored power from the storage battery and perform an air conditioning operation; a residual amount detector for detecting a storage residual amount of the storage battery; a stored power transmission/reception switching unit for switching transmission/reception of the stored power stored in the storage battery to/from the other storage type air conditioners; and a storage controller that transmits/receives information concerning the storage residual amount of the storage battery to/from the other storage type air conditioners, and controls the stored power transmission/reception switching unit so as to supply stored power of the self storage battery to another storage type air conditioner in which the storage residual amount is short with respect to the stored power supply amount when the storage residual amount of the self storage battery is surplus with respect to a stored power supply amount to be supplied to the self air conditioning unit, and also receive stored power from another storage type air conditioner in which the storage residual amount is surplus with respect to the stored power supply amount when the storage residual amount of the self storage battery is short with respect to a stored power supply amount to be supplied to the self air conditioning unit.

In the above storage type air conditioning system, each storage type air conditioner is equipped with a charger that is supplied with the external power from the external power source to charge the storage battery, and the storage controller prohibits the storage battery from being charged during the air conditioning operation of the air conditioning unit.

In the above storage type air conditioning system, the storage controller controls the charger so that the storage battery is charged in a midnight power time zone.

In the above storage type air conditioning system, the storage controller makes the charger control a current value of charging current supplied from the external power source to the storage battery on the basis of the storage residual amount detected by the residual amount detector so that the storage battery is substantially fully charged within the midnight power time zone.

In the above storage type air conditioning system, each storage type air conditioner is equipped with a charger for charging the storage battery, and the storage controller detects a current value of current flowing from the external power source into the air conditioning unit and controls the charger so that the total of the detected current value and the current value of charging current supplied from the external power source through the charger into the storage battery is not more than a predetermined value.

In the above storage type air conditioning system, the storage controller controls the charger so that the storage battery is charged in a midnight power time zone.

In the above storage type air conditioning system, the storage controller makes the charger control a current value of charging current supplied from the external power source to the storage battery on the basis of the storage residual amount detected by the residual amount detector so that the storage battery is substantially fully charged within the midnight power time zone.

According to a second aspect of the present invention, there is provided a storage type air conditioning system having plural storage type air conditioners each of which comprises: a storage battery in which external power from an external power source can be stored; an air conditioning unit that is supplied with stored power from the storage battery and perform an air conditioning operation; a residual amount detector for detecting a storage residual amount of the storage battery; a stored power transmission/reception switching unit for switching transmission/reception of the stored power stored in the storage battery to/from the other storage type air conditioners; and a communication unit for transmitting information concerning the storage residual amount of the storage battery, any one of the storage type air conditioners is set as a master machine while the other storage type air conditioners is set as a slave machine, and the master machine has a center controller for receiving information concerning the storage residual amount transmitted from the slave machines and controlling the slave machines and the master machine so that slave machines or the master machine in which the storage residual amount is surplus with respect to a stored power supply amount to be supplied to the self air conditioning unit supplies stored power to slave machines or the master machine in which the storage residual amount is short with respect to the stored power supply amount to be supplied to the self air conditioning unit.

According to a third aspect of the present invention, a method of operating a storage type air conditioning system having plural storage type air conditioners each of which comprises a storage battery in which external power supplied from an external power source can be stored, an air conditioning unit that is supplied with stored power from the storage battery and perform an air conditioning operation, a residual amount detector for detecting a storage residual amount of the storage battery, and a stored power transmission/reception switching unit for switching transmission/reception of the stored power stored in the storage battery to/from the other storage type air conditioners, comprises: transmitting/receiving information concerning the storage residual amount detected by the residual amount detector to/from other storage type air conditioners; supplying stored power to another storage type air conditioner in which the storage residual amount is short with respect to the stored power supply amount when the storage residual amount of the self storage battery is surplus with respect to the stored power supply amount to be supplied to the self air conditioning unit; and receiving stored power from another storage type air conditioner in which the storage residual amount is surplus with respect to the stored power supply amount when the storage residual amount of the self storage battery is short with respect to the stored power supply amount.

According to a fourth aspect of the present invention, there is provided a control program for controlling through a computer a storage type air conditioner comprising a storage battery in which external power supplied from an external power source can be stored, an air conditioning unit that is supplied with stored power from the storage battery and perform an air conditioning operation, a residual amount detector for detecting a storage residual amount of the storage battery, and a stored power transmission/reception switching unit for switching transmission/reception of the stored power stored in the storage battery to/from the other storage type air conditioners, the program making the computer execute: transmitting/receiving information concerning the storage residual amount detected by the residual amount detector to/from other storage type air conditioners; supplying stored power to another storage type air conditioner in which the storage residual amount is short with respect to the stored power supply amount when the storage residual amount of the self storage battery is surplus with respect to the stored power supply amount to be supplied to the self air conditioning unit; and receiving stored power from another storage type air conditioner in which the storage residual amount is surplus with respect to the stored power supply amount when the storage residual amount of the self storage battery is short with respect to the stored power supply amount.

According to the present invention, the stored power stored in the storage battery of some air conditioner(s) by using midnight power or the like can be effectively used over the air conditioning system. Furthermore, the air conditioning operation and the charging operation are prohibited from being performed at the same time, and thus the power amount consumed in the storage type air conditioner can be prevented from exceeding contract power, for example. When the air conditioning operation and the charging operation are performed at the same time, the total of the current value of the charging current flowing in the air conditioning unit and the charging current value supplied to the storage battery can be prevented from exceeding contract ampere (current).

Furthermore, the charger is controlled by the storage controller so that the storage battery is charged in the midnight power time zone in which power demand is small and the power charge is set to a low value. Therefore, the power demand can be equalized and also the power charge can be set to a low value by using the midnight power.

Still furthermore, the current value of the charging current supplied from the external power source to the storage battery is controlled on the basis of the storage residual amount detected by the residual amount detector so that the storage battery is substantially fully charged within the midnight power time zone. Therefore, the charging of the storage battery can be substantially completed with the midnight power time zone.

Still furthermore, under the control of the center controller owned by the master machine, the stored power is supplied from slaves or the master slave in which the storage residual amount is surplus with respect to the stored power supply amount to be supplied to the self air conditioning unit to slaves or the master machine in which the storage residual amount is short with respect to the stored power supply amount to be supplied to the self air conditioning unit. Therefore, the stored power stored in an individual storage battery by using midnight power or the like can be effectively used over the whole system.

DETAILED DESCRIPTION OF THE PREFERRED EMBODIMENTS

Preferred embodiments according to the present invention will be described hereunder with reference to the accompanying drawings.

First Embodiment

A first embodiment according to the present invention will be described with reference to FIGS. 1 to 4.

Figure 1:
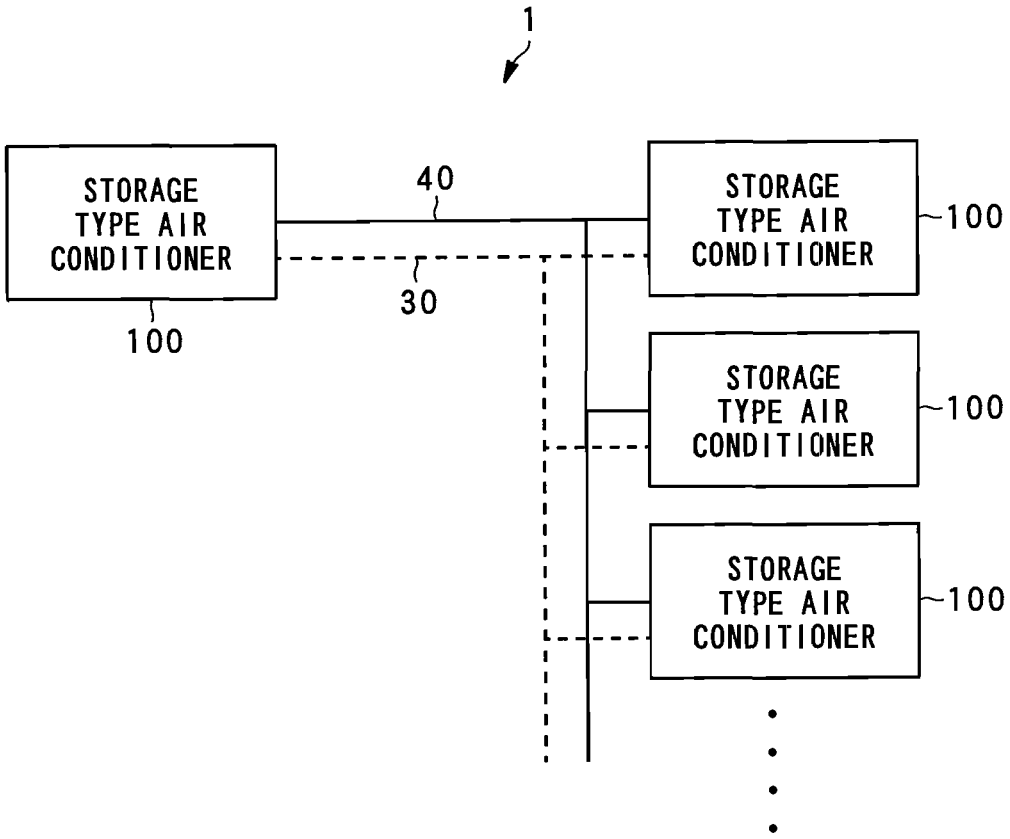
FIG. 1 is a diagram showing the construction of a storage type air conditioning system according to a first embodiment of the present invention.

FIG. 1 shows the construction of a storage type air conditioning system according to a first embodiment. As shown in FIG. 1, the storage type air conditioning system 1 according to the first embodiment is equipped with plural storage type air conditioners 100. Each storage type air conditioner 100 has a storage battery 21 (see FIG. 2), and it is designed so that the storage battery 21 is charged, for example, by using midnight power, and the storage battery 21 is discharged at the power demand peak time or the like in the daytime to execute the air conditioning operation by using stored power.

The respective storage type air conditioners 100 are designed so as to mutually transmit/receive various kinds of signals such as a control signal, etc. through a signal line in a peer-to-peer style, and also they are connected to one another through a stored power transmission/reception line 40.

In this embodiment, when the residual amount of stored power of the storage battery 21 equipped to some air conditioner of the plural storage type air conditioners constituting the storage type air conditioning system 1 has extra power with respect to its own power (self power) required for the air conditioning operation of the storage type air conditioner 100, the self stored power can be supplied to other air conditioners through the stored power transmission/reception line 40. Accordingly, the stored power can be practically used in the overall storage type air conditioning system 1.

The construction of each storage type air conditioner 100 constituting the storage type air conditioning system 1 will be described with reference to FIG. 2.

Figure 2:
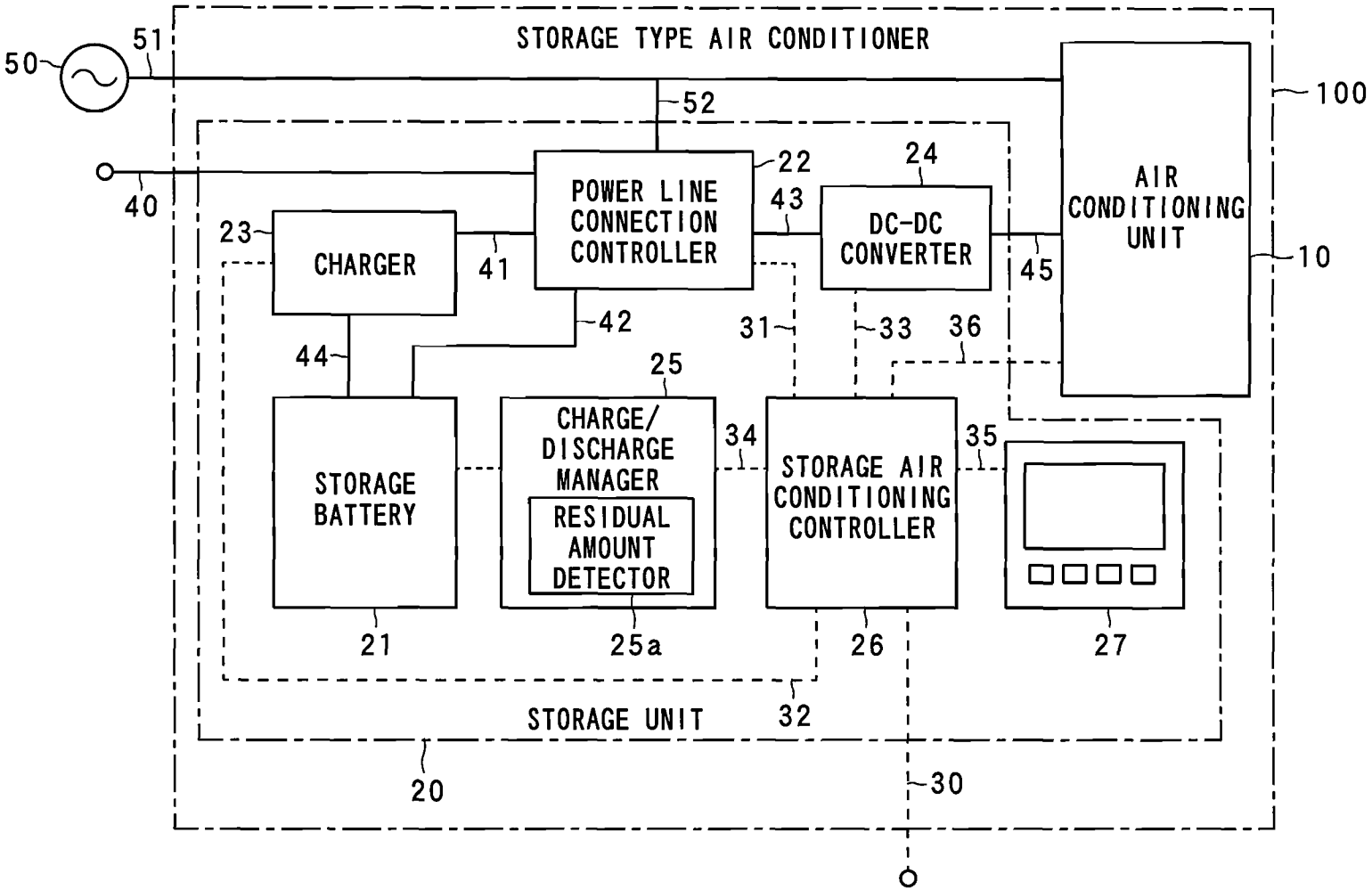
FIG. 2 is a block diagram showing the construction of a storage type air conditioner constituting the storage type air conditioning system.

The respective storage type air conditioners 100 have the same construction, and each storage type air conditioner 100 has an air conditioning unit 10 and a storage unit 20 as shown in FIG. 2 and is connected to a commercial power source 50 as an external power source.

The air conditioning unit 10 has an outdoor unit (not shown), and one or plural indoor units connected to the outdoor unit through a refrigerant circuit, and it is connected to the commercial power source 50 through a power supply line 51 so that it is supplied with external power to perform an air conditioning operation. The air conditioning unit 10 contains an AC-DC converter (not shown) therein. AC power supplied from the commercial power source 50 is converted to DC power having a predetermined voltage in the AC-DC converter, and the air conditioning unit 10 is actuated by the DC power.

The storage unit 20 is equipped with a storage battery 21, a power line connection controller (stored power transmission/reception switching unit) 22 which is connected to various kinds of power lines and switches the connection of these power lines, a charger (charging unit) 23 for charging the storage battery 21, a DC-DC converter 24 for converting stored power discharged from the storage battery 21 to DC power of a predetermined voltage, a charge/discharge manager 25 for managing charge/discharge of the storage battery 21, a storage air conditioning controller (storage controller) 26 for controlling the charge/discharge of the storage battery 21, the switching operation of the power lines, etc. and also transmitting/receiving a control signal to/from the air conditioning unit 10 and a storage control panel 27.

As the storage battery 21 may be used a lead storage battery, a sodium/sulfur battery, a sodium/nickel chloride battery, a lithium ion secondary battery, a lithium ion polymer secondary battery, a nickel hydrogen storage battery, a nickel cadmium storage battery, an electric double layer capacitor or the like.

The power line connection controller 22 is equipped with a breaker, a magnet switch, etc., and selectively connect the various kinds of power lines to the power line connection controller 22 or release the connection concerned, thereby switching the connection of the various kinds of power lines.

Specifically, the power line connection controller 22 is connected to the power supply line 51 through an auxiliary power supply line 52, and also connected to the charger 23 through a first charging power supply line 41. Under the control of the storage air conditioning controller 26, the power line connection controller 22 can electrically connect the auxiliary power supply line 52 and the first charging power supply line 41 or release the connection concerned.

Furthermore, the power line connection controller 22 is connected to the storage battery 21 through a first discharging power supply line 42, and also connected to the DC-DC converter 24 through a second discharging power supply line 43. Under the control of the storage air conditioning controller 26, the power line connection controller 22 can electrically connect the first discharging power supply line 42 and the second discharging power supply line 43 or release the connection concerned.

Still furthermore, the power line connection controller 22 is connected to the other storage type air conditioners 100 through the stored power transmission/reception line 40. Under the control of the stored air conditioning controller 26, the power line connection controller 22 switches the connection of the power lines so that the stored power transmission/reception line 40 and the second discharging power supply line 43 are connected to each other when stored power is supplied from another storage type air conditioner 100, and the first discharging power supply line 42 and the stored power transmission/reception line 40 are connected to each other when the stored power of the self storage battery 21 is supplied to another storage type air conditioner 100. Accordingly, the switching operation of the transmission/reception of the stored power stocked in the storage battery 21 to/from the other storage type air conditioners 100 can be performed.

The charger 23 contains a DC-AC converter (not shown) for converting AC power supplied from the first charging power supply line 41 through the power line connection controller 22 to DC power and outputting the DC power to the second charging power supply line 44. Under the control of the storage air conditioning controller 26, the charger 23 supplies the DC power to the storage battery 21 through the second charging power supply line 44 to charge the storage battery 21.

The DC-DC converter 24 is connected to the power line connection controller 22 through the second discharging power supply line 43, and also connected to the air conditioning unit 10 through the stored power supply line 45. Under the control of the storage air conditioning controller 26, the DC-DC converter 24 converts DC power supplied from the second discharging power supply line 43 through the power line connection controller 22 to DC power of a predetermined voltage, and supplies the DC power to the air conditioning unit 10 through the stored power supply line 45.

The charge/discharge manager 25 has a residual amount detector (residual amount detecting unit) 25*a* for detecting the battery residual amount (storage electricity residual amount) of the storage battery 21, and manages the charge/discharge in accordance with the characteristic of the storage battery 21 every type of the storage battery 21. Under the control of the storage air conditioning controller 26, the charge/discharge manager 25 detects the storage (stored electricity) residual amount of the storage battery 21, and outputs the information concerning the storage residual amount to the storage air conditioning controller 26.

The storage control panel 27 has a display unit constructed by a liquid crystal panel or the like, an operating unit having various kinds of input buttons, etc., and it is designed so that various kinds of instruction signals can be input through the operating unit and set contents, etc. can be displayed on the display unit.

The storage air conditioning controller 26 is equipped with MPU, ROM, RAM, a time count circuit, etc. (not shown), and under the cooperation of these elements, the power line connection controller 22, the charger 23, the DC-DC converter 24, the charge/discharge manager 25 and the storage control panel 27 are controlled by the computer. However, the power line connection controller 22, the charger 23, the DC-DC converter 24, the charge/discharge manager 25, the storage control panel 27 and the storage air conditioning controller 26 are connected to one another through signal lines 31 to 35.

Furthermore, the storage air conditioning controller 26 is configured to communicate with the storage air conditioning controllers 26 of the other storage type air conditioners 100 according to a predetermined communication system. The storage air conditioning controller 26 transmits/receives information concerning the storage residual amount of the self storage battery 21 at a predetermined time interval while being synchronized with the other storage type air conditioners 100.

The storage air conditioning controller 26 is connected to the air conditioning unit 10 through the signal line 36. When the air conditioning controller 10 is actuated by the stored power, the storage air conditioning controller 26 transmits a control signal to the air conditioning unit 10 through the signal line 36 so that the stored power supplied through the stored power supply line 45 is controlled to act as operating power.

As described above, the storage air conditioning controller 26 is connected to the charge/discharge manager 25 through the signal line 34, and transmits various kinds of control signals to the charge/discharge manager 25 to control the charge/discharge of the storage battery 21. Specifically, the charge/discharge of the storage battery 21 is controlled by the charge/discharge manager 25 so that when a predetermined time (the star time of a charging time zone) comes on the basis of the time counted by the time count circuit, the charging of the storage battery 21 is started, and when a predetermined time (the start time of a discharging time zone) comes, the discharge of the storage battery 21 is started. Furthermore, the power line connection controller 22 and the respective parts are controlled so that the stored power is supplied/received to/from another storage type air conditioner 100 under a predetermined condition.

The operation concerning the charge and discharge of the storage battery 21 in the storage battery air conditioner 100 will be described with reference to FIGS. 3 and 4.

First, the operation concerning the charge of the storage battery 21 will be described with reference to FIG. 3.

The charge of the storage battery 21 is assumed to be executed in a midnight power time zone (for example, PM11:00 to AM7:00 (midnight power time zone) as the predetermined time, AM 1:00 to AM6:00 (second midnight power time zone). This is because the midnight power time zone is a time zone in which power demand is a little and also an electric power charge is set to a low value. The storage battery 21 is charged by using this midnight power, and the storage battery 21 is discharged at the peak time of the power demand, so that the midnight power can be effectively used and it can contribute to the equalization of loads.

Figure 3:
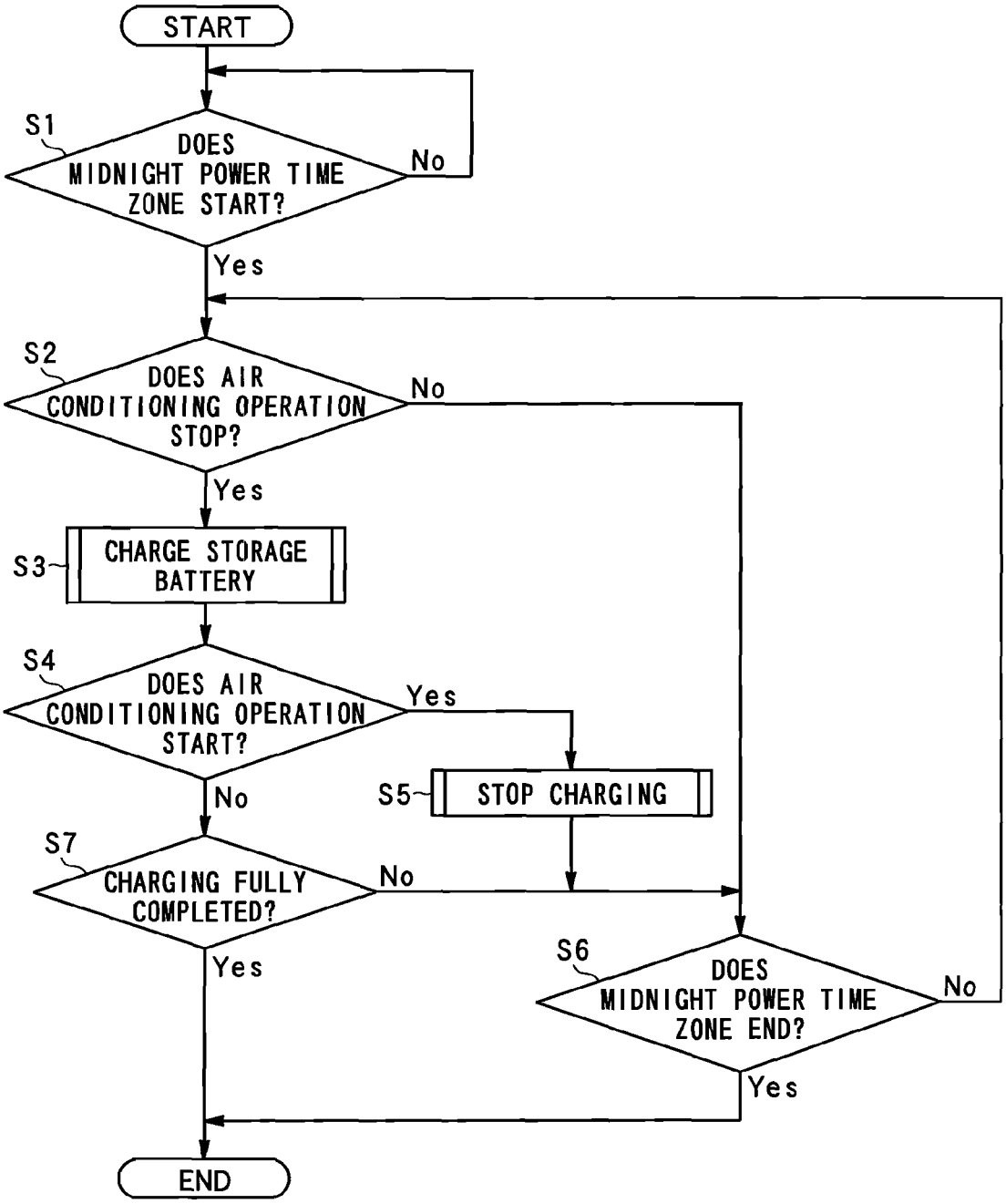
FIG. 3 is a flowchart showing an operation associated with charging of a storage battery.
Figure 4:
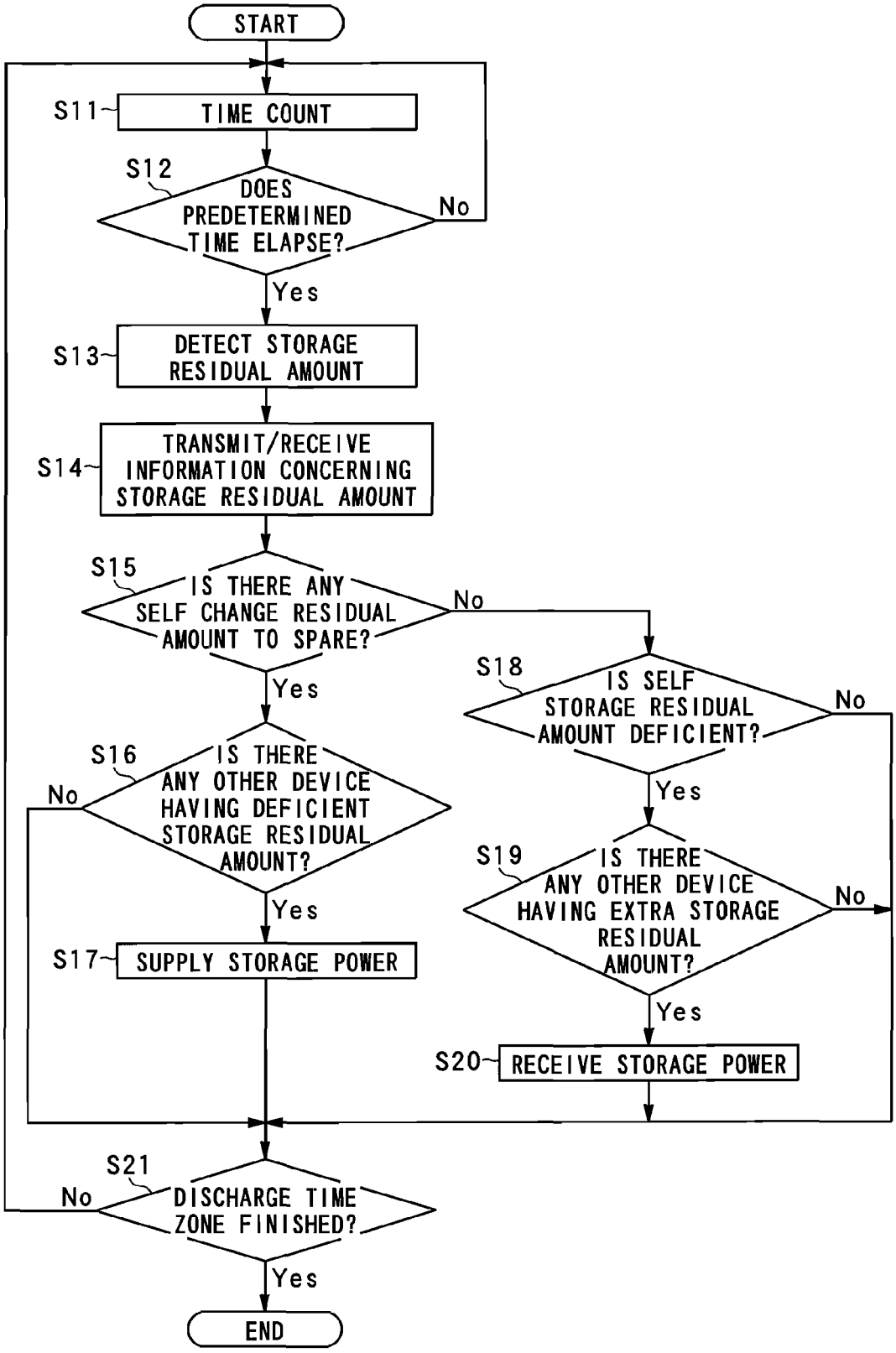
FIG. 4 is a flowchart showing an operation associated with transmission/reception of stored power in the first embodiment.

As shown in FIG. 3, when the start time of a preset charting time zone has come on the basis of by time count circuit contained in the storage air conditioning controller 26 (step S1: Y), the storage air conditioning controller 26 first transmits/receives the control signal to/from the air conditioning unit 10, and judges whether the air conditioning operation is carried out in the air conditioning unit 10 (step S2). If it is judged in the air conditioning unit 10 that the air conditioning operation is stopped (step S2: Y), the storage air conditioning controller 26 transmits the control signal to the charge/discharge manager 25, and also transmits the control signal to the power line connection controller 22, whereby the auxiliary power supply line 52 and the first charge power supply line 41 are connected to each other and the charge of the storage battery 21 is started (step S3).

The charge of the storage battery 21 in step S3 is managed by the charge/discharge manager 25 under the control of the storage air conditioning controller 26. The charge/discharge manager 25 manages the charge of the storage battery 21 so that DC current having a predetermined current value is supplied from the charger 23 within a predetermined temperature range in accordance with the characteristic of the storage battery 21. Furthermore, the storage residual amount of the storage battery 21 is detected by the residual amount detector 25*a* every predetermined time. Under the management of the charge/discharge manager 25, the current value of the charge current supplied through the second charging power supply line 44 is controlled in accordance with the storage residual amount by the storage air conditioning controller 26 so that the storage battery 21 is substantially fully charged, preferably fully charged within the midnight power time zone.

During the charging period of the storage battery 21, the storage air conditioning controller 26 monitors the start or non-start of the air conditioning operation in the air conditioning unit 10 (step S4). When the air conditioning operation is started in the air conditioning unit 10 (step S4: Y), the storage air conditioning controller 26 transmits a control signal to the power line connection controller 22 to release the connection between the auxiliary power supply line 52 and the first charging power supply line 41, and also transmits a control signal to the air conditioning unit 10 so that the AC power from the commercial power source 50 is supplied to the air conditioning unit 10 as an operating power source (step S5).

If the end time of the midnight power time zone has not yet elapsed (step S6: N), the processing returns to the step S2 again, and waits until the air conditioning operation of the air conditioning unit 10 is stopped.

On the other hand, if no air conditioning operation is executed in the air conditioning unit 10 (step S4: N) from the start of the charge of the storage battery 21 (step S3), the above processing is repeated within the midnight power time zone until the storage battery 21 is fully charged, and the processing is finished if the storage battery 21 is fully charged (step S7: Y).

Next, the operation concerning the discharge of the storage battery 21 will be described.

In this embodiment, the time zone in which the storage battery 21 is discharged is set to a predetermined time zone in advance. The time zone for discharging the storage battery 21 is set except for the midnight power time zone in which the storage battery 21 is charged. Furthermore, since the storage type air conditioner 100 is introduced for the purpose of the load equalization at the peak time of the power demand, the time zone in which the storage battery 21 is discharged is mainly set so as to contain the power peak time (for example, AM10:00 to PM5:00 or the like). From the viewpoint of effectively using the stored power of the storage battery 21, the time zone in which the storage battery 21 is discharged may be set so as to contain a time zone excluding the midnight power time zone in addition to the power demand peak time. As described above, the time zone in which the storage battery 21 is discharged is set so as to contain not only the power demand peak time, but also the time other than the power demand peak time, whereby the stored power stored from the midnight power can be effectively used, so that the power demand in the daytime can be reduced and also the electric power charge can be reduced.

The operation concerning the transmission/reception of the stored power to/from another storage type air conditioner 100 which is executed in the preset discharge time zone of the storage battery 21 (the time zone in which the storage battery 21 is discharged) will be described with reference to FIG. 4.

When the preset start time of the discharge time zone of the storage battery 21 has come, the storage air conditioning controller 26 starts the time counting of the time count circuit contained therein (step S11). When a predetermined time elapses (step S12: Y), the storage air conditioning controller 26 transmits a control signal to the charge/discharge manager 25 so that the storage residual amount of the storage battery 21 is detected by the residual amount detector 25*a* (step S13). Subsequently, the storage air conditioning controller 26 transmits/receives information concerning the storage residual amount detected in step S13 to/from the other storage type air conditioners 100 (step S14).

Here, the information concerning the storage residual amount may be information concerning the storage residual amount itself or information as to whether the storage residual amount is short or surplus with respect to the stored power supply amount to be supplied to the self air conditioning unit 10. However, it can be judged on the basis of the comparison between the storage residual amount of the storage battery 21 and a threshold value whether the storage residual amount of the storage battery 21 is short or surplus with respect to the stored power supply amount to be supplied to the self air conditioning unit 10 as described later.

Subsequently, in step S15 it is judged on the basis of the storage residual amount of the self storage battery 21 whether the self storage residual amount is surplus with respect to the stored power supply amount to be supplied to the self air conditioning unit 10.

Here, it may be judged on the basis of the comparison with a preset threshold value whether the self storage residual amount is surplus with respect to the stored power supply amount to be supplied to the self air conditioning unit 10. This threshold value may be set on the basis of a power demand prediction which is made to the air conditioning unit 10. The power demand prediction may be made on the basis of a past operation record or the weather of that day. Alternatively, the power demand prediction may be simply made on the basis of the average power demand amount of a day of the air conditioning unit 10.

If it is judged in step S15 that the stored power of the self storage battery 21 is surplus (step S15: Y), the storage air conditioning controller judges on the basis of information concerning the storage residual amounts received from the other storage type air conditioners 100 whether there is any other storage type air conditioner 100 in which the storage residual amount is short with respect to the stored power supply amount (step S16).

If it is judged that there is any other storage type air conditioner in which the storage residual amount is short (step S16: Y), the first discharge power supply line 42 and the stored power transmission/reception line 40 are connected to each another by the power line connection controller 22 to supply the stored power to the other storage type air conditioner 100 (step S17).

On the other hand, if it is judged in step S15 that the storage residual amount of the self storage battery 21 is not surplus (step S15: N), then it is judged whether the storage residual amount of the self storage battery 21 is short with respect to the stored power supply amount (step S18).

Here, it may be judged on the basis of the comparison with the above threshold value whether the storage residual amount is short with respect to the stored power supply amount. Furthermore, the threshold value used to judge whether the storage residual amount is surplus with respect to the stored power supply amount may be made different from the threshold value used to judge whether the storage residual amount is short with respect to the stored power supply amount.

If it is judged that the self storage residual amount is short (step S18: Y), the storage air conditioning controller 26 judges on the basis of the information concerning the storage residual amounts received from the other storage type air conditioners 100 whether there is any other storage type air conditioner 100 in which the storage residual amount is surplus with respect to the stored power supply amount (step S19).

If there is any other storage type air conditioner 100 in which the storage residual amount is surplus with respect to the stored power supply amount (step S19), the storage air conditioning controller 26 transmits a control signal to the power line connection controller 22 to connect the stored power transmission/reception line 40 and the second discharging power supply line 43 so that the stored power is supplied from another storage type air conditioner 100 (step S20).

The above processing is repeated until the time zone in which the storage battery 21 is discharged is finished (step S21: Y). That is, the storage residual amount of the self storage battery 21 is detected every predetermined time interval (step S13), and transmits/receives the information concerning the storage residual amount while synchronized with the other storage type air conditioners 100 (step S14). If the self storage residual amount is surplus (step S15: Y), the stored power is supplied to another storage type air conditioner 100 in which the storage residual amount is short (step S17), and if the self storage residual amount is short (step S18: Y), the stored power is supplied from another storage type air conditioner 100 in which the storage residual amount is surplus (step S20).

According to the first embodiment as described above, the storage air conditioning controller 26 detects the storage residual amount of the self storage battery 21 by the residual amount detector 25*a*. The power line connection controller 22 is controlled by the storage air conditioning controller 26 so that when the storage residual amount is surplus with respect to the stored power supply amount to be supplied to the self air conditioning unit 10, the stored power is supplied to another storage type air conditioner 100 in which the storage residual amount is short with respect to the stored power supply amount, and when the storage residual amount of the self storage battery 21 is short with respect to the stored power supply amount to be supplied to the self air conditioning unit 10, the stored power is received from another storage type air conditioner 100. Therefore, the stored power which is stored in the individual storage batteries 21 equipped to the respective storage type air conditioners 100 by using midnight power or the like can be effectively used in the overall storage type air conditioning system 1.

Furthermore, in this embodiment, the storage air conditioning controller 26 controls the charger 23, etc. so that the storage battery 21 is charged in the midnight power time zone, and the charging operation is prohibited when the air conditioning operation is executed in the air conditioning unit 10.

That is, the air conditioning operation and the charging operation are prohibited from being carried out at the same time, whereby the power amount consumed in the storage type air conditioner 100 can be prevented from exceeding a contract power demand, for example.

Furthermore, the charger 23 is controlled by the storage air conditioning controller 26 so as to charge the storage battery 21 in the midnight power time zone in which the power demand is small and the electric power rate is set to a low value. Therefore, this embodiment can contribute to the equalization of the power demand and also reduce the electric power rate by using the midnight power.

Still furthermore, according to this embodiment, the storage residual amount of the storage battery 21 is detected by the residual amount detector 25*a* every predetermined time when the storage battery 21 is charged, and thus the AC power amount supplied to the storage battery 21 can be reduced on the basis of the storage residual amount of the storage battery 21.

Second Embodiment

Next, a storage type air conditioning system according to a second embodiment will be described with reference to FIGS. 5 to 7. The same elements as the first embodiment are represented by the same reference numerals, and the description thereof is omitted.

Figure 5:
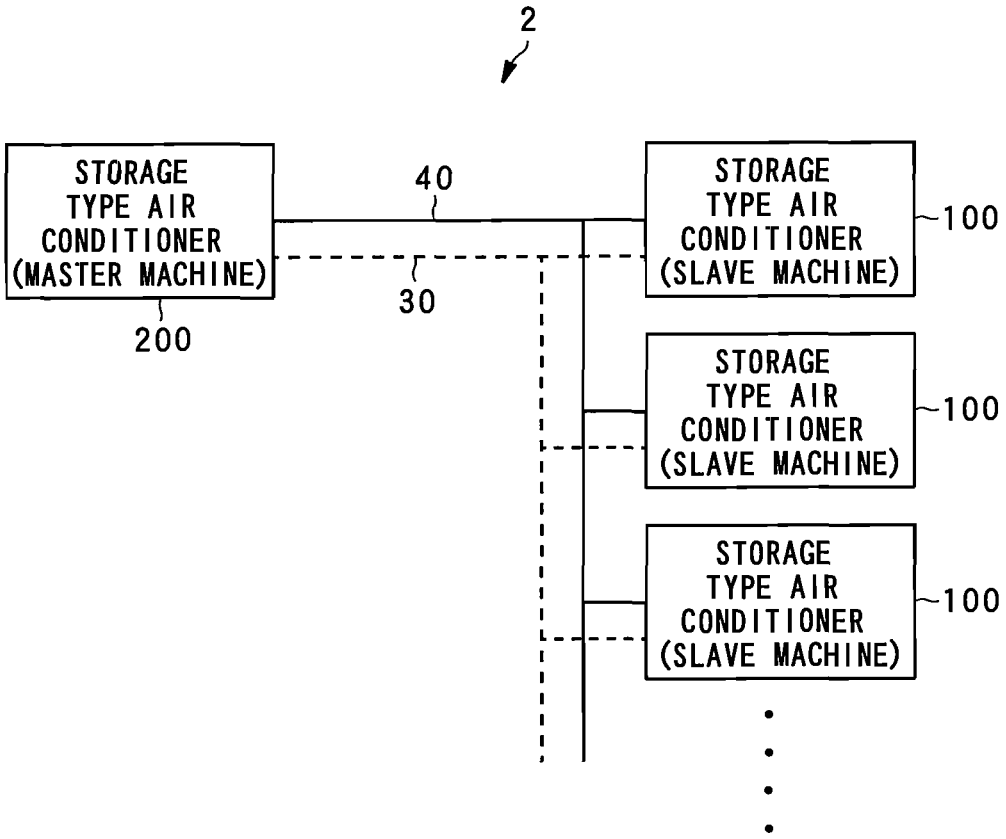
FIG. 5 is a diagram showing the construction of a storage type air conditioning system according to a second embodiment of the present invention.

FIG. 5 shows the construction of the storage type air conditioning system 2 according to the second embodiment. As shown in FIG. 5, the storage type air conditioning system 2 of this embodiment is equipped with plural storage type air conditioners 100, 200 as in the case of the first embodiment. In the second embodiment, one storage type air conditioner 200 out of the plural storage type air conditioners 100, 200 is set as a master machine (200), and the other storage type air conditioners 100 are set as slave machines (100).

The apparatus construction of the slave machines 100 is substantially equal to the apparatus construction of the storage type air conditioner 100 of the first embodiment (FIG. 2). However, the storage air conditioning controller 26 transmits the information concerning the storage residual amount of the self storage battery 21 to the master machine 200.

Figure 6:
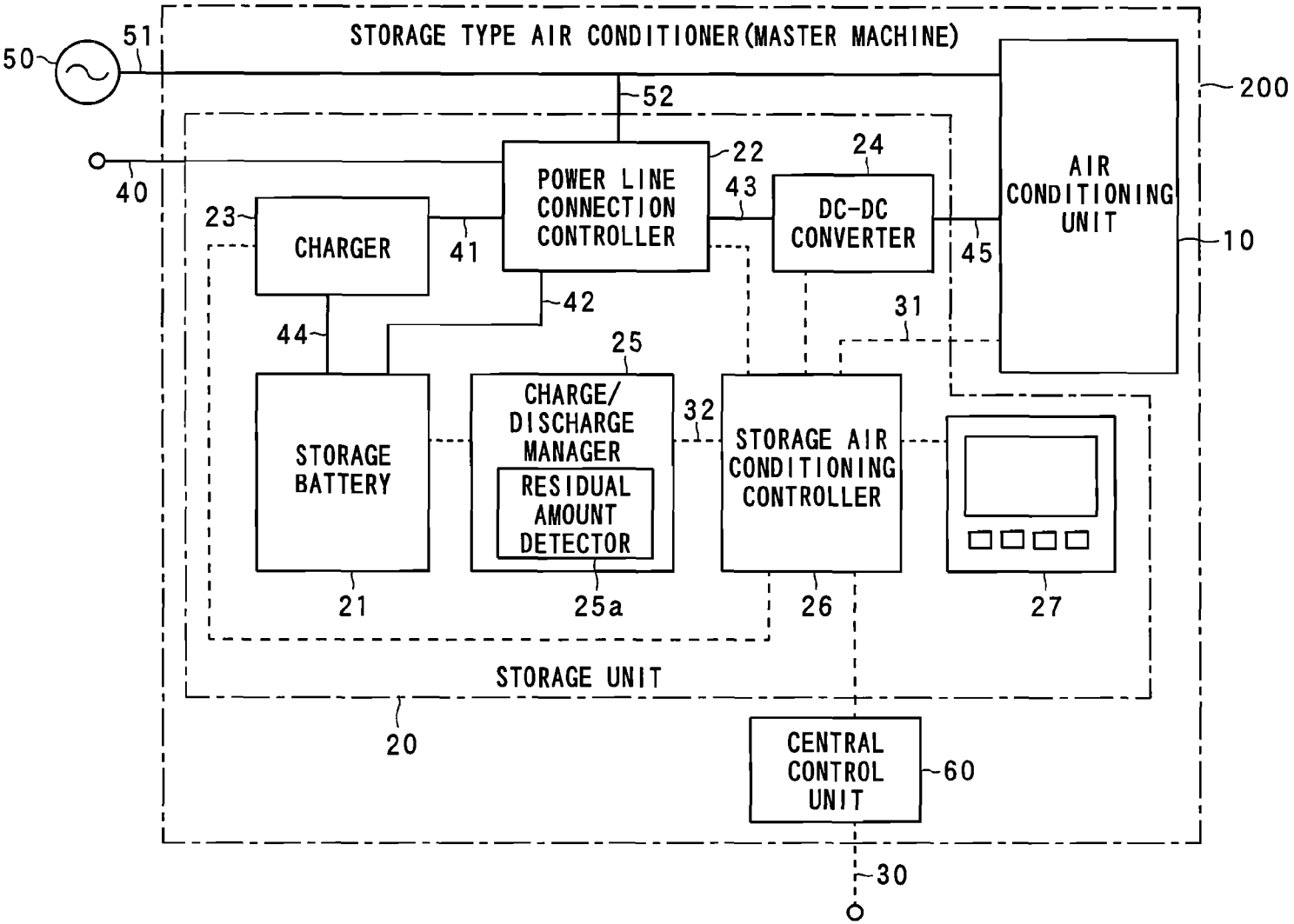
FIG. 6 is a diagram showing the construction of a storage type air conditioner set as a master machine.
Figure 7:
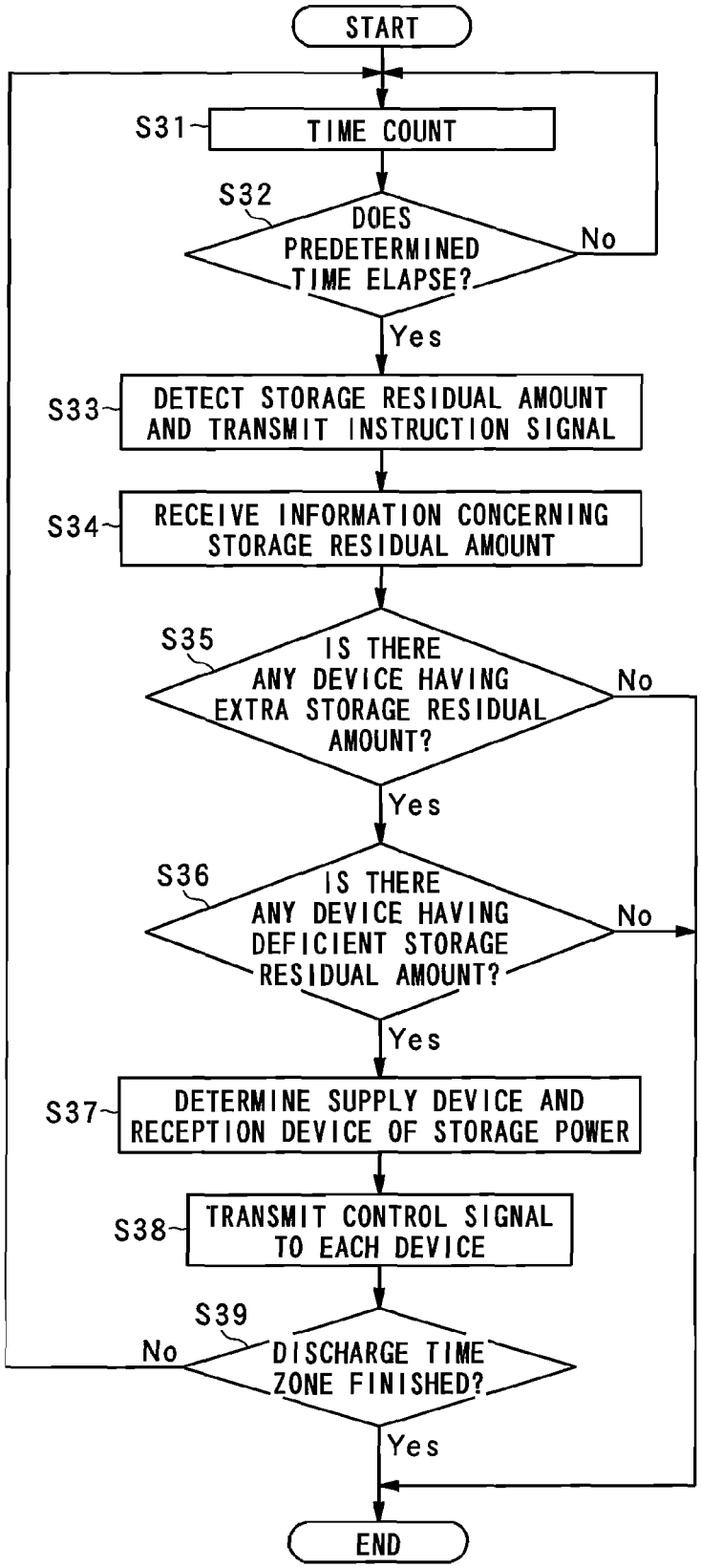
FIG. 7 is a flowchart showing an operation associated with transmission/reception of stored power in the second embodiment.

As shown in FIG. 6, the master machine 200 has substantially the same construction as the slave machines 100, and also has a center controller 60. The center controller 60 receives information concerning the storage residual amounts transmitted from the slave machines 100, and controls to supply stored power from a slave machine 100 or the master machine 200 in which the storage residual amount of the storage battery 21 is surplus with respect to the stored power supply amount to be supplied to the self air conditioning unit 10 to a slave machine 100 or the master machine 200 in which the storage residual amount of the storage battery 21 is short with respect to the stored power supply amount to be supplied to the self air conditioning unit 10.

The operation concerning the transmission/reception of the stored power in the storage type air conditioning system which is executed under the control of the master machine 200 in a time zone preset as a discharge time zone of the storage battery 21 as in the case of the first embodiment will be described with reference to FIG. 7.

When the preset start time of the discharge time zone of the storage battery 21 has come, the center controller 60 transmits a control signal to the self storage air conditioning controller 26 and starts the time count by the time count circuit contained in the storage air conditioning controller 26 (step S31). When a signal representing that a predetermined time has elapsed is input from the storage air conditioning controller 26 to the center controller 60 (step S32: Y), the center controller 60 transmits a residual amount detection instructing signal to the self charge/discharge manager 25 and the slave machines 100, and controls the residual amount detector 25*a* to detect the storage residual amount of the storage battery 21 (step S33). Subsequently, the center controller 60 receives information concerning the storage residual amount detected in step S33 through the storage air conditioning controller 26 of the self storage air conditioning controller 26 or the slave machines 100 (step S34).

Here, as in the case of the first embodiment, the information concerning the storage residual amount may be information concerning the storage residual amount itself or may be information as to whether the storage residual amount is short or surplus with respect to the stored power supply amount to be supplied to the self air conditioning unit 10. However, whether the storage residual amount is short or surplus with respect to the stored power supply amount to be supplied to the self air conditioning unit 10 may be judged on the basis of the comparison between the storage residual amount and the threshold value as in the case of the first embodiment.

Subsequently, on the basis of the information concerning the storage residual amount received in step S34, it is judged whether there is any slave machine 100 and/or the master machine 200 in which the self storage residual amount is surplus with respect to the stored power supply amount to be supplied to the self air conditioning unit 10 (step S35).

If it is judged in step S35 that there is some slave machine 100 and/or master machine 200 in which the store power of the storage battery 21 is surplus, the center controller 60 judges on the basis of the information concerning the storage residual amount whether there is any slave machine 100 and/or the master machine 200 in which the storage residual amount is short with respect to the stored power supply amount (step S36).

When there is some slave machine(s) 100 and/or the master machine 200 in which the storage residual amount is short (step S36: Y), the central controller 60 determines slave machines 100 and/or the master machine 200 (supply apparatus) for supplying the stored power to other slave machines 100 and/or the master machine 200, and slave machines 100 and/or the master machine 200 (receiving apparatus) for receiving the stored power from other slave machines 100 and/or the master machine 200 (step S37).

Here, when the number of the slave machines 100 and/or the master machine 200 in which the storage residual amount is short is plural and the number of the slave machines 100 and/or the master machine 200 in which the storage residual amount is surplus is plural, with respect to which slave machines 100 or the master machine 200 supply the stored power to which slave machines 100 or the master machine 200, for example, the supply apparatus and the receiving apparatus are determined like the transmission/reception of the stored power is carried out between apparatuses located at adjacent positions, for example.

Furthermore, when the number of the slave machines 100 and/or the master machine 200 in which the storage residual amount is surplus is larger than the number of the slave machines 100 and/or the master machine 200 in which the storage residual amount is short, the supply apparatuses for the stored power may be determined in the decreasing order of the storage residual amount, or the supply apparatuses for the stored power may be determined so that the transmission/reception of the stored power is carried out between the apparatuses located at adjacent positions.

Next, the central controller 60 transmits a control signal to the slave machines 100 or the master machine 200 as supply apparatuses and the slave machines 100 or the master machine 200 as reception apparatus, and controls these slave machines 200 and/or the master machine 200 so that the slave machines 100 and/or the master machine 200 in which the storage residual amount is surplus supply the stored power to the slave machines 100 and/or the master machine 200 in which the storage residual amount is short (step S38).

Here, when receiving the control signal from the center controller 60, according to the content of the control signal, the storage air conditioning controller 26 of the slave machine (s) 10 and/or the master machine 200 in which the storage residual amount is short connects the stored power transmission/reception line 40 and the second discharging power supply line 43 through the power line connection controller 22 so as to supply the stored power received from another storage type air conditioner 100 (200) to its own (i.e., self) air conditioning unit 10.

On the other hand, when receiving the control signal from the center controller 60, according to the content of the control signal, the slave machine(s) 100 and/or the master machine 200 in which the storage residual amount is surplus connects the stored power transmission/reception line 40 and the first discharging power supply line 42 through the power line connection controller 22 to supply the stored power to another (other) storage type air conditioner(s) 100 (200). At this time, when the stored power is also supplied to the self air conditioning unit 10, the first discharging power supply line 42 is branched and connected to both the stored power transmission/reception line 40 and the second discharging power supply line 43 in the power line connection controller 22.

The above processing is repeated until the discharge time zone of the storage battery 21 is finished (step S39: Y).

As described above, according to the second embodiment, under the control of the center controller 60 owned by the master machine 200, the slave machine 100 or the master machine 200 in which the storage residual amount is surplus with respect to the stored power supply amount to be supplied to the self air conditioning unit 10 supplies the stored power to the slave machine 100 or the master machine 200 in which the storage residual amount is short with respect to the stored power supply amount to be supplied to the self air conditioning unit 10, and thus the stored power stored in the storage battery 21 can be effectively used in the overall storage type air conditioning system by using the midnight power or the like.

Unlike the first embodiment, the control signal is transmitted from the master machine 200 to each slave machine 100 to detect the storage residual amount, etc. in the second embodiment, and thus it is easy to establish the synchronization among the respective machines 100 (200).

The present invention is not limited to the above-described first and second embodiments, and various kinds of modifications may be properly made without departing from the subject matter of the present invention.

For example, in the above embodiments, the charging of the storage battery 21 as shown in FIG. 3 is prohibited during the period when the air conditioning operation is carried out. However, the charging of the storage battery 21 may be performed simultaneously with the air conditioning operation by detecting the current value of current flowing from the commercial power source 50 to the air conditioning unit 10 and controlling the current value of the charging current so that the total of the detected current value and the current value of the charging current supplied from the commercial power source 50 through the charger 23 to the storage battery 21 is not more than a predetermined value such as a contract current value (ampere) or the like.

What is claimed is:

1. A storage type air conditioning system having a plurality of storage type air conditioners, wherein each of the plurality of storage type air conditioners comprises:

a storage battery in which external power from an external power source can be stored;

an air conditioning unit that is supplied with stored power from the storage battery and performs an air conditioning operation;

a residual amount detector for detecting a storage residual amount of the storage battery;

a stored power transmission and reception switching unit for switching transmission and reception of the stored power stored in the storage battery to and from the other storage type air conditioners;

a storage controller that transmits and receives information concerning the storage residual amount of the storage battery to and from one of the plurality of storage type air conditioners, and controls the stored power transmission and reception switching unit so as to supply stored power of the storage battery to another of the plurality of storage type air conditioner in which the storage residual amount is short with respect to the stored power supply amount when the storage residual amount of the storage battery is surplus with respect to a stored power supply amount to be supplied to the air conditioning unit, and also receive stored power from another of the plurality of storage type air conditioner in which the storage residual amount is surplus with respect to the stored power supply amount when the storage residual amount of the storage battery is short with respect to a stored power supply amount to be supplied to the air conditioning unit;

wherein the storage controller is connected to an information transmitting and receiving signal line connected to the plurality of storage type air conditioners, and transmits information concerning the storage residual amount of the storage battery of said one of the plurality of storage type air conditioners and receives information concerning the storage residual amount of the storage battery of each of the other of the plurality of storage type air conditioners; and a surplus stored power transmitting or receiving line for transmitting or receiving surplus stored power to or from another of the plurality of storage type air conditioners on the basis of the information concerning the storage residual amount of the storage battery.

2. The storage type air conditioning system according to claim 1, wherein each storage type air conditioner is equipped with a charger that is supplied with the external power from the external power source to charge the storage battery, and the storage controller prohibits the storage battery from being charged during the air conditioning operation of the air conditioning unit.

3. The storage type air conditioning system according to claim 2, wherein the storage controller controls the charger so that the storage battery is charged in a midnight power time zone.

4. The storage type air conditioning system according to claim 2, wherein the storage controller makes the charger control a current value of charging current supplied from the external power source to the storage battery on the basis of the storage residual amount detected by the residual amount detector so that the storage battery is substantially fully charged within a midnight power time zone.

5. The storage type air conditioning system according to claim 1, wherein each storage type air conditioner is equipped with a charger for charging the storage battery, and the storage controller detects a current value of current flowing from the external power source into the air conditioning unit and controls the charger so that a total of the detected current value and the current value of charging current supplied from the external power source through the charger into the storage battery is not more than a predetermined value.

6. The storage type air conditioning system according to claim 5, wherein the storage controller controls the charger so that the storage battery is charged in a midnight power time zone.

7. The storage type air conditioning system according to claim 5, wherein the storage controller makes the charger control a current value of charging current supplied from the external power source to the storage battery on the basis of the storage residual amount detected by the residual amount detector so that the storage battery is substantially fully charged within the midnight power time zone.

8. A storage type air conditioning system having a plurality of storage type air conditioners including first storage type air conditioner serving as a master machine and a second storage type air conditioner serving as a slave machine, wherein each of the plurality of storage type air conditioners comprises:

a storage battery in which external power from an external power source can be stored;

an air conditioning unit that is supplied with stored power from the storage battery and performs an air conditioning operation;

a residual amount detector for detecting a storage residual amount of the storage battery;

a stored power transmission and reception switching unit for switching transmission and reception of the stored power stored in the storage battery to and from another of the plurality of storage type air conditioners; and a communication unit for transmitting information concerning the storage residual amount of the storage battery, wherein the storage type air conditioning system comprises:

an information transmitting and receiving signal line connected to the plurality of storage type air conditioners to transmit and receive information concerning the storage residual amount of the storage battery from one of the plurality of storage type air conditioners to another of the plurality of storage type air conditioners; and a surplus stored power transmitting or receiving line for transmitting or receiving surplus stored power from one of the plurality of storage type air conditioners to another of the plurality of storage type air conditioners on the basis of the information concerning the storage residual amount of the storage battery, wherein the master machine has a center controller for receiving information concerning the storage residual amount transmitted from the slave machine and controlling the slave machine and the master machine so that the slave machine or the master machine in which the storage residual amount is surplus with respect to a stored power supply amount to be supplied to the air conditioning unit supplies stored power to the slave machine or the master machine in which the storage residual amount is short with respect to the stored power supply amount to be supplied to the air conditioning unit.

9. A method of operating a storage type air conditioning system having a plurality of storage type air conditioners each of which comprises a storage battery in which external power supplied from an external power source can be stored, an air conditioning unit that is supplied with stored power from the storage battery and performs an air conditioning operation, a residual amount detector for detecting a storage residual amount of the storage battery, and a stored power transmission and reception switching unit for switching transmission and reception of the stored power stored in the storage battery to and from the other storage type air conditioners, wherein the storage type air conditioning system comprises an information transmitting and receiving signal line connected to the plurality of storage type air conditioners to transmit and receive information concerning the storage residual amount of the storage battery from one of the plurality of storage type air conditioners to another of the plurality of storage type air conditioners, and a surplus stored power transmitting or receiving line for transmitting or receiving surplus stored power from one of the plurality of storage type air conditioners to another of the plurality of storage type air conditioners on the basis of the information concerning the storage residual amount of the storage battery, comprising:

transmitting and receiving information concerning the storage residual amount detected by the residual amount detector to and from another of the plurality of storage type air conditioners;

supplying stored power to another of the plurality of storage type air conditioner in which the storage residual amount is short with respect to the stored power supply amount when the storage residual amount of the storage battery is surplus with respect to the stored power supply amount to be supplied to the air conditioning unit; and receiving stored power from another of the plurality of storage type air conditioner in which the storage residual amount is surplus with respect to the stored power supply amount when the storage residual amount of the storage battery is short with respect to the stored power supply amount, wherein the information concerning the storage residual amount of the storage battery is transmitted and received at a predetermined time interval.

10. A non-transitory computer-readable medium storing a control program for controlling through a computer a first storage type air conditioner comprising a storage battery in which external power supplied from an external power source can be stored, an air conditioning unit that is supplied with stored power from the storage battery and performs an air conditioning operation, a residual amount detector for detecting a storage residual amount of the storage battery, and a stored power transmission and reception switching unit for switching transmission and reception of the stored power stored in the storage battery to and from a plurality of storage type air conditioners, wherein the storage type air conditioning system comprises an information transmitting and receiving signal line connected to the plurality of storage type air conditioners to transmit and receive information concerning the storage residual amount of the storage battery from one of the plurality of storage type air conditioners to another of the plurality of storage type air conditioners, and a surplus stored power transmitting or receiving line for transmitting or receiving surplus stored power from one of the plurality of storage type air conditioners to another of the plurality of storage type air conditioners on the basis of the information concerning the storage residual amount of the storage battery, the program making the computer execute:

transmitting and receiving information concerning the storage residual amount detected by the residual amount detector to and from the plurality of storage type air conditioners;

supplying stored power to one of the plurality of storage type air conditioner in which the storage residual amount is short with respect to the stored power supply amount when the storage residual amount of the storage battery is surplus with respect to the stored power supply amount to be supplied to the air conditioning unit; and receiving stored power from another of the plurality of storage type air conditioner in which the storage residual amount is surplus with respect to the stored power supply amount when the storage residual amount of the storage battery is short with respect to the stored power supply amount, wherein the information concerning the storage residual amount of the storage battery is transmitted and received at a predetermined time interval.

* * * * *